US005911614A

United States Patent [19]

Nishimura et al.

[11] Patent Number: 5,911,614

[45] Date of Patent: Jun. 15, 1999

[54] FIELD EMISSION DEVICE AND METHOD FOR MANUFACTURING SAME

[75] Inventors: Norio Nishimura; Toshio Kaneshige; Masateru Taniguchi; Takahiro Niiyama; Teruo Watanabe; Minoru Katayama, all of Mobara, Japan

[73] Assignee: Futaba Denshi Kogyo K.K., Mobara, Japan

[21] Appl. No.: 08/834,924

[22] Filed: Apr. 7, 1997

[51] Int. Cl.[6] ..... H01J 1/16

[52] U.S. Cl. ..... 445/25; 313/309; 313/583

[58] Field of Search ..... 445/24, 25; 313/309, 313/336, 351, 583

[56] References Cited

U.S. PATENT DOCUMENTS 5,578,903 11/1996 Pepi ..... 313/583

5,594,297 1/1997 Shen et al. ..... 313/336

5,624,293 4/1997 Khan et al. ..... 445/25

5,844,360 12/1998 Jeong et al. ..... 313/336 X

*Primary Examiner*—Kenneth J. Ramsey

*Attorney, Agent, or Firm*—Oblon, Spivak, McClelland, Maier & Neustadt, P.C.

[57] ABSTRACT

A field emission device capable of facilitating manufacturing thereof. A cathode substrate is formed on the same plane thereof with gate terminals and cathode electrode each having an end acting as a cathode terminal, on which an insulating layer is arranged. The insulating layer is formed thereon with gate lines 8, which are connected to the gate terminals through a conductive film deposited in contact holes formed during formation of the gate electrodes.

5 Claims, 8 Drawing Sheets

FIELD EMISSION DEVICE AND METHOD FOR MANUFACTURING SAME

BACKGROUND OF THE INVENTION

This invention relates to a field emission device and a method for manufacturing the same.

When an electric field set to be about $10^9$ (V/m) is applied to a surface of a metal material or that of a semiconductor material, a tunnel effect occurs to permit electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode" (hereinafter also referred to as "FEC").

Recently, development of semiconductor fine-processing techniques permits a field emission cathode of the surface emission type to be constructed of field emission cathode elements having a size as small as microns. Arrangement of the thus-constructed field emission cathodes in large numbers on a substrate is expected to permit the field emission cathodes to act as an electron source for a display device of the flat type or any electronic device.

Such a field emission device may be manufactured according to, for example, a rotational oblique deposition method developed by Spindt, which is disclosed in U.S. Pat. No. 3,789,471.

Now, manufacturing of the field emission device by the Spindt method will be described with reference to FIGS. 10(*a*) to 10(*c*) and 11.

First, as shown in FIG. 10(*a*), a substrate 21 made of glass or the like is formed thereon with stripe-like cathodes 22, which are made of a metal layer by deposition and patterning. Then, a $SiO_2$ layer 23 made by thermal oxidation of silicon and acting as an insulating layer is deposited on the substrate 21 so as to cover the cathodes 22, followed by formation of a gate layer on the insulating layer 23 by deposition or the like. The gate layer is made of a film of metal such as niobium (Nb) or the like.

Subsequently, a photoresist (not shown) is coated on the gate layer, followed by patterning of gates 24 in a manner to be substantially vertically perpendicular to the cathodes 22. Then, etching is carried out to form the gates 24 with apertures 25.

Then, the substrate 21 is subject to rotational deposition of aluminum (Al), which is carried out in a direction oblique to the substrate 21 while turning or rotating the substrate 21, leading to deposition of a peel layer. This results in the peel layer being selectively deposited on a surface of the gates 24 while being kept from being deposited in the apertures 25.

Thereafter, a molybdenum (Mo) layer is formed on the peel layer by deposition, so that emitters 27 of a conical shape (FIG. 11) may be depositedly formed in the apertures.

Succeedingly, the peel layer and deposited Mo layer on the gates 24 are removed therefrom by etching and then the gates 24 are formed thereon with a protective film layer 26, which is subject to patterning as shown in FIG. 10(*c*), to thereby provide protective films 26*a* for the gates 24. Subsequently, the gates 24 and cathodes 22 are subject to terminal lead-out processing, resulting in cathode terminals 22*a* and gate terminals 24*a* being formed.

Above the protective films 26*a* is arranged an anode substrate 29 in a manner to be spaced from the cathode substrate 21, as shown in FIG. 11. A seal 28 is interposedly arranged between both substrates 21 and 29, to thereby keep the space at a high vacuum when it is evacuated.

As shown in FIG. 11, the cathodes 22 are formed on the cathode substrate 21 and then a resistive layer is formed on each of the cathodes. The emitters 27 are arranged on the resistive layer. The gates 4 each are formed on the cathode 22 through the insulating layer 23 and the emitters 27 each are exposed at a distal end thereof through the aperture 25 of a circular shape.

In the thus-formed FEC of the surface discharge type, application of a drive voltage VGE of tens of volts between the gates 24 and the cathodes 22 permits the emitters 27 to emit electrons, which are then captured by the anode 29 which is spacedly arranged above the gate 24 and to which an anode voltage VA is applied.

When a phosphor is provided on the anode 29, it is excited by electrons captured by the anode 29, leading to luminescence.

As noted from the above, the FEC is so constructed that electrons travel in the space, thus, the cathode substrate 21 and anode substrate 29 are sealedly joined to each other through the seal 28, to thereby ensure operation of the FEC in a vacuum environment. Also, the seal 28 is arranged on the protective film 26*a* as shown in FIG. 10(*c*), to thereby prevent electrical disconnection in the FEC due to oxidation/reduction of the gate 24 by the seal 28, migration of the seal 28 or the like.

The protective film 26*a*, as shown in FIG. 10(*b*), is formed by subjecting the gate 24 to patterning on the insulating layer 23, forming the protective film layer 26 on the gate 24 by vapor deposition and subjecting the protective film layer 26 to patterning Thus, the prior art requires a step of independently preparing the protective film 26*a*.

Also, in the prior art, the cathode terminal 22*a* and gate terminal 24*a* are formed on the layers different from each other, respectively, as shown in FIG. 10(*c*), therefore, the terminal lead-out processing requires patternings carried out in steps different from each other.

Unfortunately, this causes manufacturing of the FEC to be highly complicated.

SUMMARY OF THE INVENTION

The present invention has been made in view of the foregoing disadvantage of the prior art.

Accordingly, it is an object of the present invention to provide a field emission device which is capable of permitting manufacturing thereof to be substantially simplified.

In accordance with one aspect of the present invention, a field emission device is provided. The field emission device includes a field emission cathode substrate and an anode substrate sealedly joined to the field emission cathode substrate while being spaced therefrom, cathode electrodes and gate terminals arranged on the same plane of the field emission cathode substrate, and gate lines arranged on the cathode electrodes through an insulating layer. The insulating layer and gate lines are formed with apertures in a manner to commonly extend through the insulating layer and gate lines. The field emission device also includes emitters of a conical shape arranged in the apertures to emit electrons therefrom and contact holes through which the gate terminals and gate lines are connected to each other. The insulating layer is so arranged that a part thereof formed on the gate terminals acts as a protective film for a seal for sealed joining of the anode substrate.

In a preferred embodiment of the present invention, the contact holes are formed into a diameter larger than that of the apertures.

In accordance with another aspect of the present invention, a method for manufacturing a field emission device including a field emission cathode substrate and an anode substrate sealedly joined to the field emission cathode substrate while being spaced therefrom. The method comprises the step of forming cathode electrodes and gate terminals on the same plane of the field emission cathode substrate. The cathode electrodes each have an end arranged so as to act as a cathode terminal. The method further comprises the steps of forming an insulating layer on the cathode electrodes and gate terminals and forming contact holes on the insulating layer, whereby gate electrodes formed on the insulating layer are connected to said gate terminals through a conductive film formed in the contact holes during formation of the gate electrodes.

In a preferred embodiment of the present invention, the conductive film formed in the contact holes is formed by oblique deposition.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 7(*b*) is an enlarged view of a portion encircled in FIG. 7(*a*);

FIG. 8(*b*) is an enlarged view of a portion encircled in FIG. 8(*a*);

DETAILED DESCRIPTION OF THE PREFERRED EMBODIMENT

Now, a field emission device according to the present invention will be described hereinafter with reference to the accompanying drawings.

Figure 1:
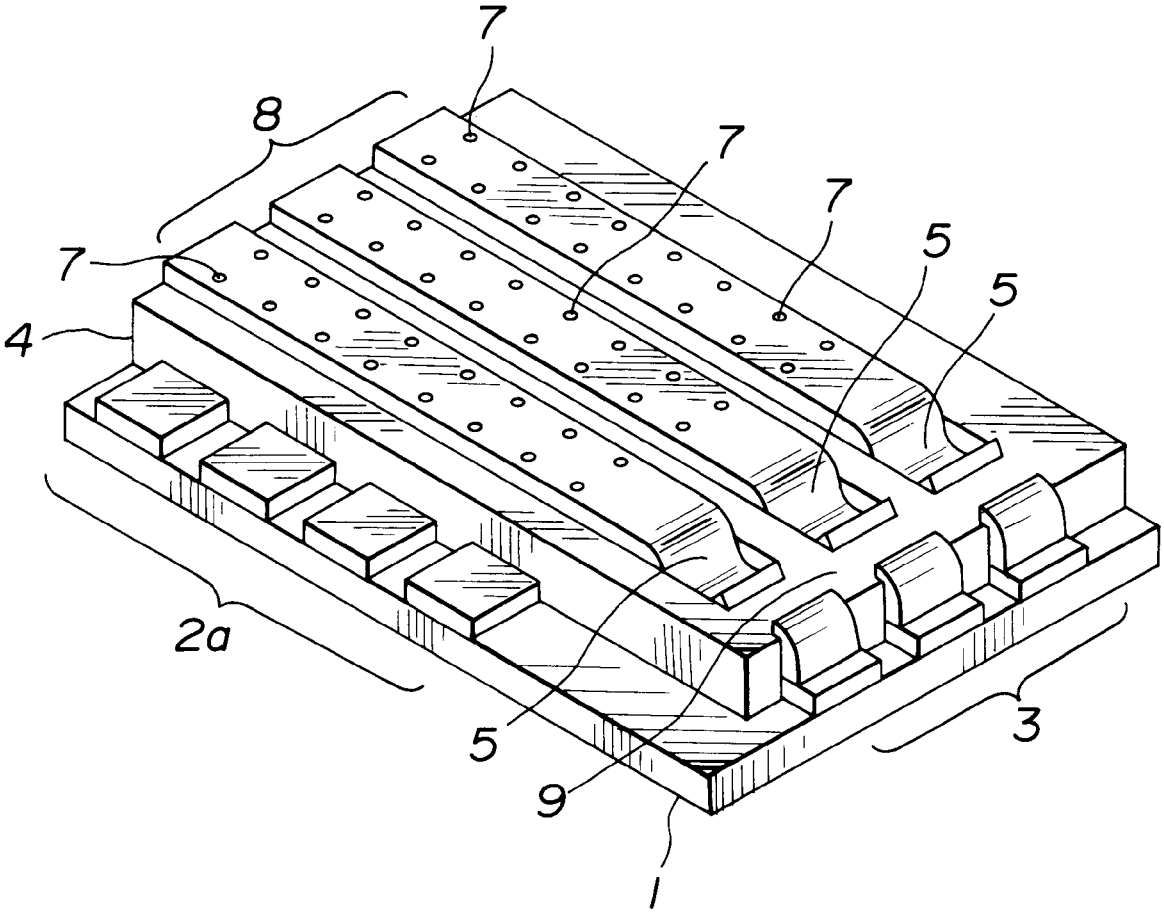
FIG. 1 is a perspective view generally showing an embodiment of a field emission device according to the present invention.

Referring first to FIG. 1, an embodiment of a field emission device according to the present invention is illustrated. A field emission device of the illustrated embodiment includes a substrate 1 made of glass or the like. The substrate 1 is provided on the same plane thereof with cathode terminals 2*a* and gate terminals 3. Also, the substrate 1 is formed thereon with a $SiO_2$ layer or an insulating layer 4 so as to cover both cathode terminals 2*a* and gate terminals 3. The insulating layer 4 is made by subjecting silicon to thermal oxidation. The cathode terminals 2*a* are arranged so as to extend into the insulating layer 4, to thereby provide cathode electrodes.

The insulating layer 4 is formed thereon with gate lines 8 in a manner to perpendicularly intersect the cathode electrodes. The gate lines 8 each are made of a layer of metal such as niobium (Nb) or the like. The gate lines 8 are connected to the gate terminals 3 through contact holes 5, respectively, as described hereinafter. Also, the gate lines 8 each are formed with apertures 7 so as to commonly extend through both gate line 8 and insulating layer 4, in each of which an emitter of a conical shape (not shown) is arranged while being placed on the cathode electrode.

Reference numeral 9 designates a protective film, which is made using a part of the insulating layer 4 formed on the gate terminals 3. This permits the protective film 9 to be made concurrently with the insulating layer 4, resulting in eliminating a step of independently preparing the protective film 9 or forming it separately from the insulating layer 4. Also, the cathode terminals 2*a* and gate terminals 3 are formed on the same plane of the substrate 1, so that the number of times of terminal lead-out patterning or processing may be only one.

Now, manufacturing of the field emission device of the illustrated embodiment thus constructed will be described with reference to FIGS. 2 to 8(*b*).

Figure 2:
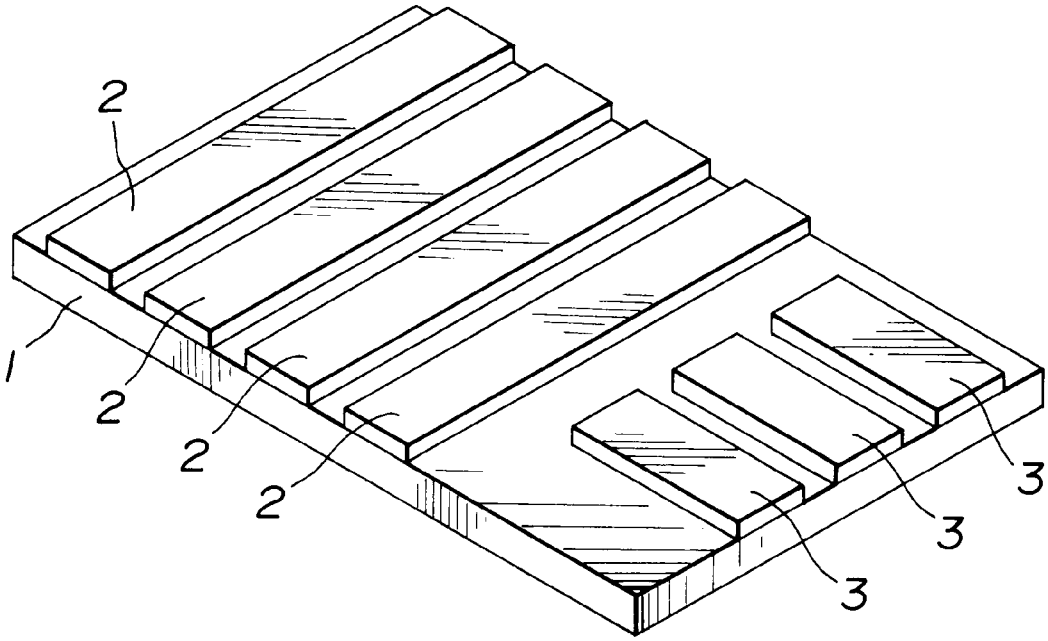
FIG. 2 is a perspective view showing a first intermediate obtained by one of steps in manufacturing of the field emission device of FIG. 1.
Figure 3:
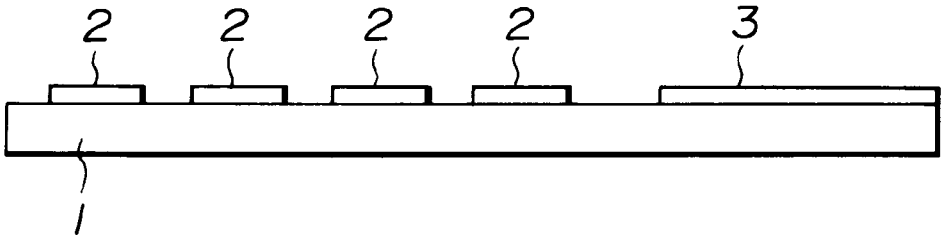
FIG. 3 is a side elevation view of the first intermediate shown in FIG. 2.

First, as shown in FIGS. 2 and 3, the cathode lines 2 are formed on the cathode substrate 1 and then the gate terminals 3 are formed on the substrate 1 in a manner to be perpendicular to the cathode lines 2. The cathode lines 2 each act at an end thereof as the cathode terminal 2*a*.

Figure 4:
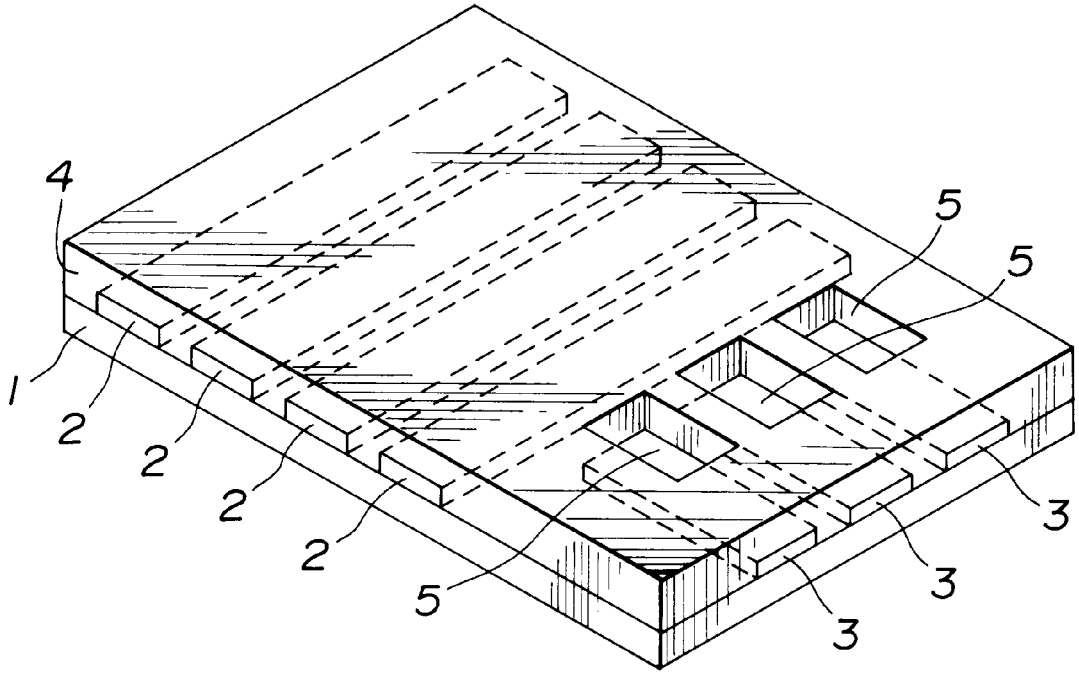
FIG. 4 is a perspective view showing a second intermediate obtained by a step subsequent to the step shown in FIG. 2.
Figure 5:
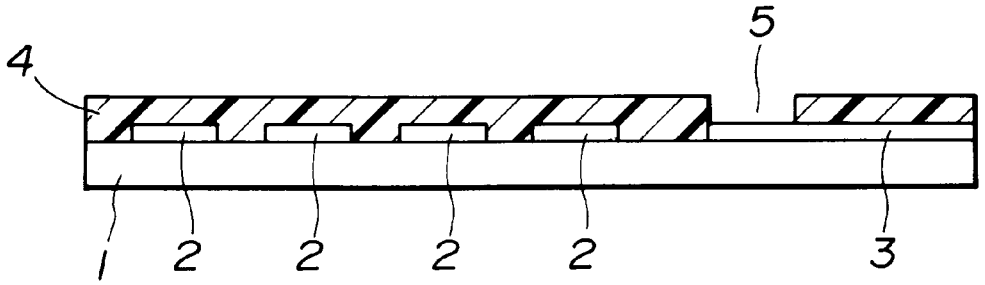
FIG. 5 is a side elevation view of the second intermediate shown in FIG. 4.

Then, as shown in FIGS. 4 and 5, the insulating layer 4 is arranged and then provided with the contact holes 5, respectively. More particularly, the insulating layer 4 is formed on the cathode lines 2 and gate terminals 3 and then subject to patterning, resulting in being formed with the contact holes 5 so as to be positioned on the gate terminals 3. The contact holes 5 may be formed independently for each of the gate terminals 3. Alternatively, they may be formed continuously so as to be common to all the gate terminals 3. Also, the contact holes 5 are formed into an increased diameter as compared with that of the apertures 7 in which the emitters are arranged.

Figure 6:
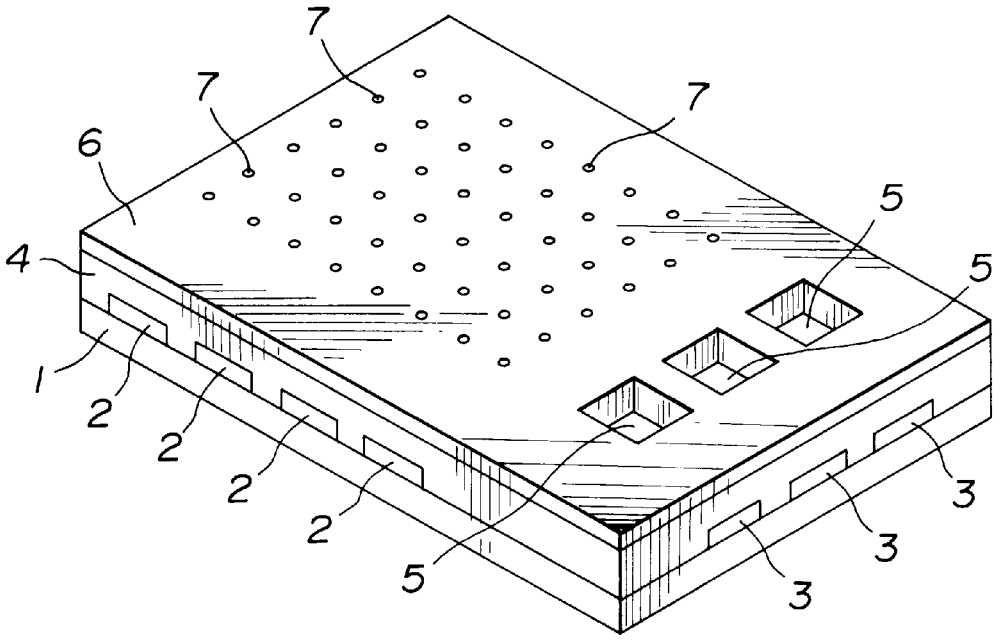
FIG. 6 is a perspective view showing a third intermediate obtained by a step subsequent to the step shown in FIG. 4.
Figure 7A:
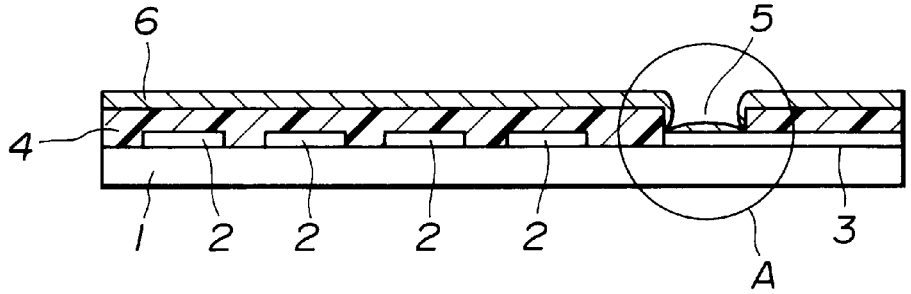
FIG. 7(*a*) is a sectional view of the third intermediate shown in FIG. 6.
Figure 7B:
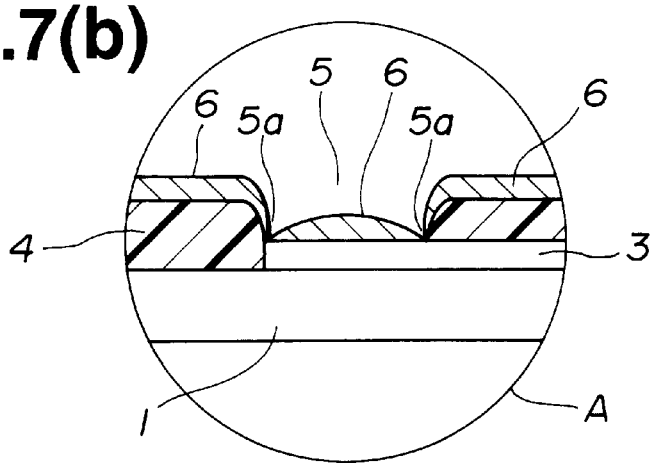

Subsequently, as shown in FIGS. 6 and 7(*a*), the gate film 6 is formed on the insulating layer 4 by, for example, sputtering and then the apertures 7 in which the emitters are to be arranged are formed. Alternatively, formation of the apertures 7 may be carried out in such a state as shown in FIGS. 4 and 5 and then gate film 6 may be formed by rotational oblique deposition. In this instance, formation of the contact holes 5 into a size larger than that of the apertures 7 permits the gate film 6 to be deposited in an inner surface of the contact holes and a side surface thereof while keeping it from being deposited in the apertures 7.

Deposition of the gate film 6 on the side surface of the contact holes 5 establishes connection between the gate film 6 and the gate terminals 3. Nevertheless, an excessive increase in angle of inclination of the side surface of each of the contact holes 5 often leads to a failure in contact at an end 5*a* of the contact hole 5 as shown in FIG. 7(*b*) resulting in connection between the gate film 6 and each of the gate terminals 3 being often failed.

Figure 8A:
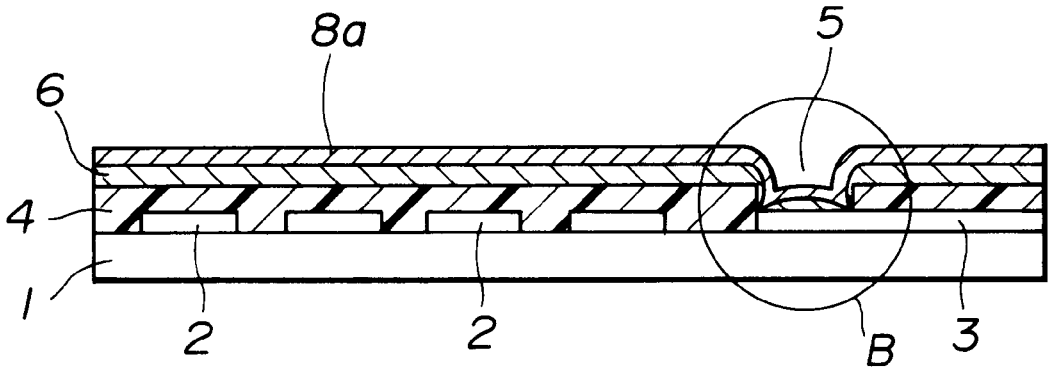
FIG. 8(*a*) is a sectional view showing a fourth intermediate obtained by a step subsequent to the step shown in FIG. 6.
Figure 8B:
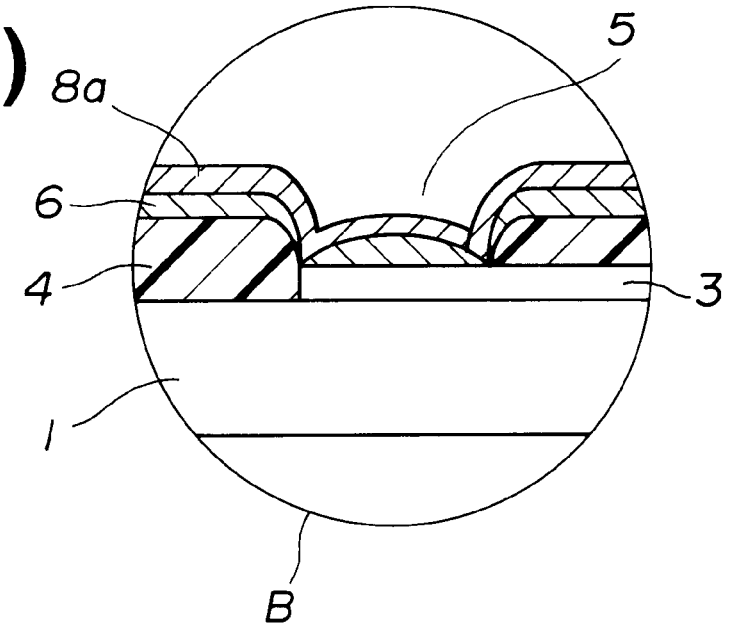

In order to avoid such a problem, niobium or the like is formed on the gate film 6 by rotational oblique deposition, to thereby provide a gate film 8*a* on the gate film 6, as shown in FIG. 8(*a*). Thus, the gate lines 8 each are constructed into a two-layer structure including the gate film 6 and gate film 8*a*. Such construction permits the gate film 8*a* to ensure satisfactory connection between the gate film 6 and the gate terminals 3, to thereby effectively prevent such a failure in contact as described above.

Thereafter, a peel layer (not shown) is formed on the gate film 8*a* by rotational oblique deposition and then an emitter layer is formed on the peel layer, resulting in conical emitters (not shown) being formed in the apertures 7.

Formation of the gate film 8*a* by rotational oblique deposition permits an opening of each of the apertures 7 to be reduced in size. This significantly reduces a distance between each of the gate lines 8 and each of the emitters, to thereby facilitate discharge of electrons from the emitters, leading to an increase in electric field strength. Then, the peel layer is removed together with the emitter layer thereon, followed by patterning of the insulating layer 4, resulting in terminal lead-out processing of the cathode terminals 2*a* and gate terminals 3 and formation of the protective layer 9 using a part of the insulating layer 4. Thus, the field emission device as shown in FIG. 1 is satisfactorily provided.

Figure 9:
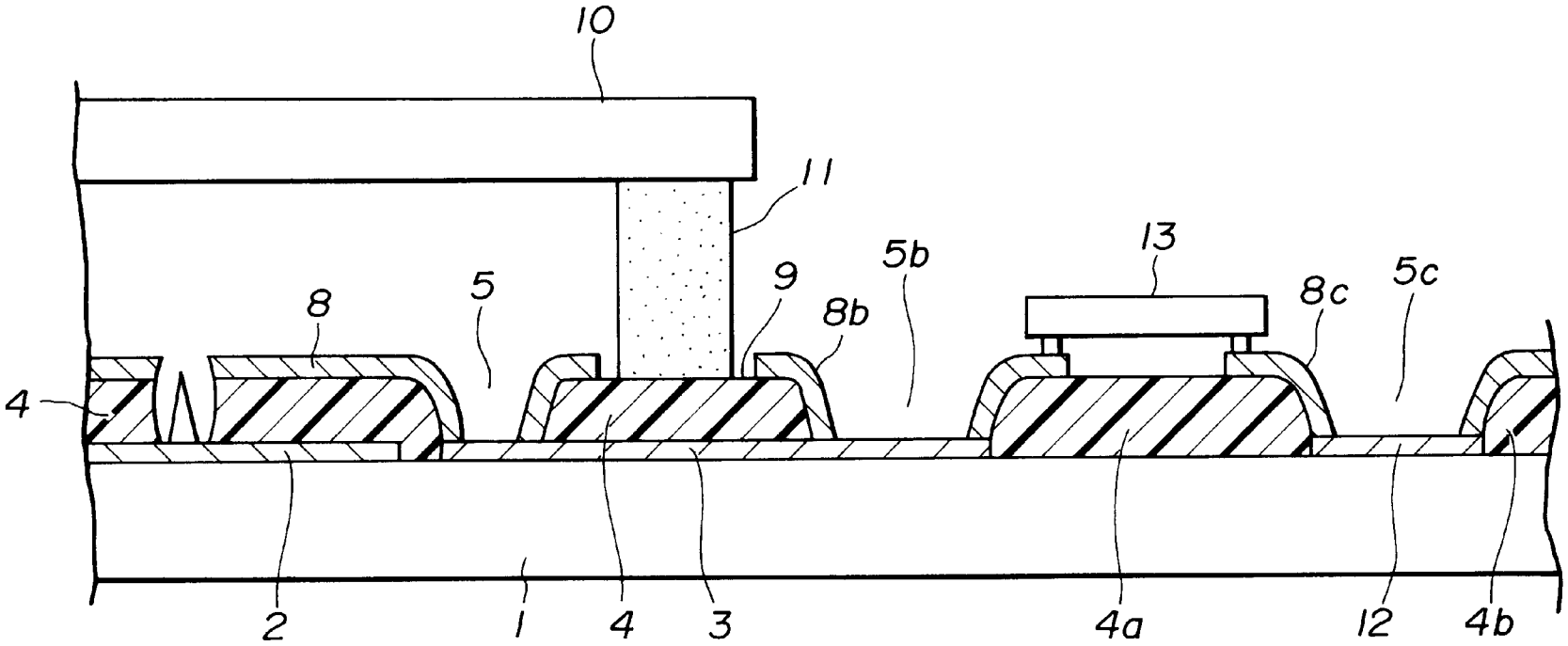
FIG. 9 is a sectional view showing the field emission device shown in FIG. 1.
Figure 10A:
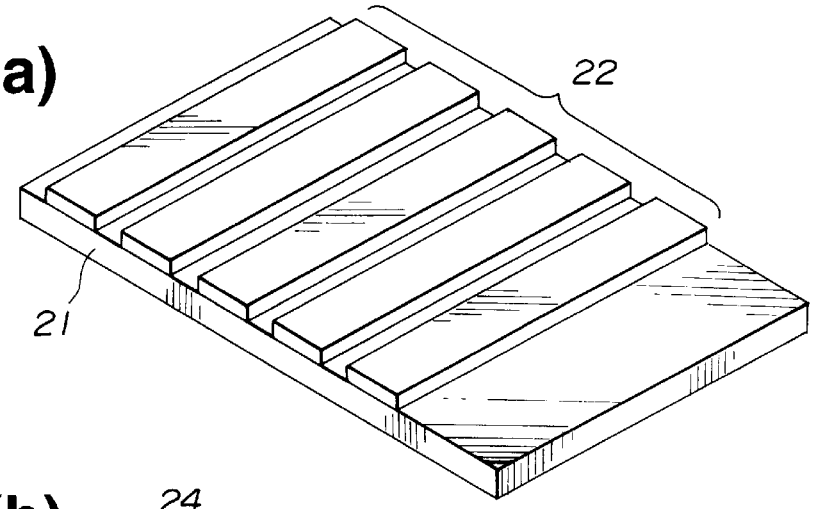
FIGS. 10(*a*) to 10(*c*) each are a perspective view showing each of steps in manufacturing of a conventional field emission device.
Figure 10B:
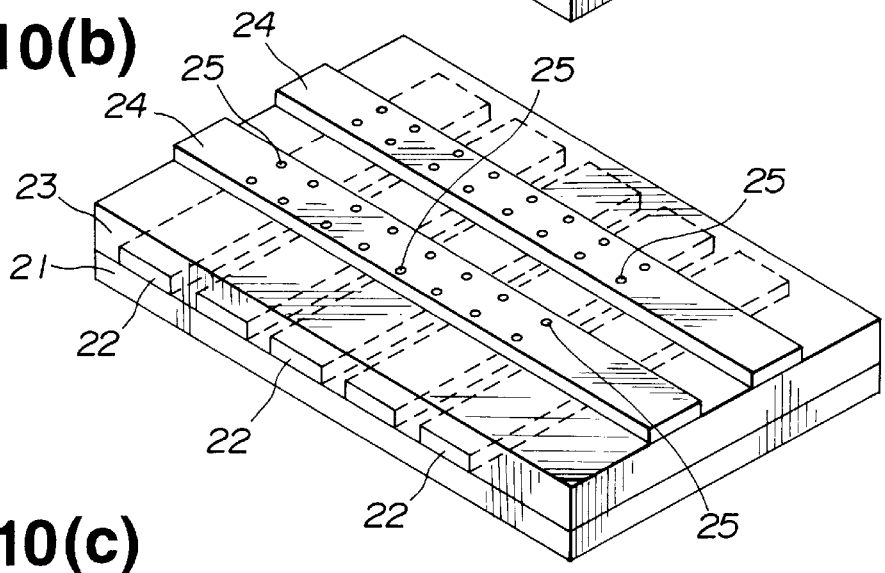
Figure 10C:
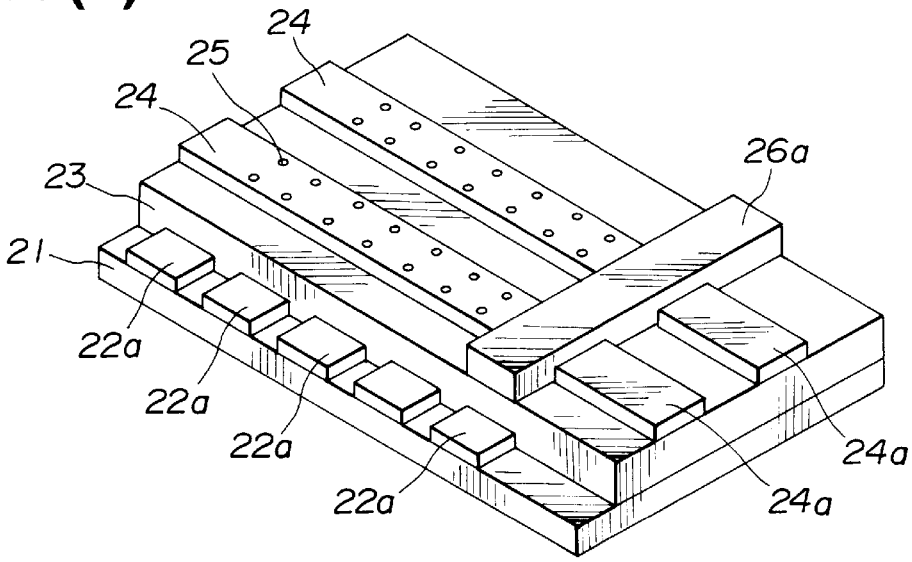
Figure 11:
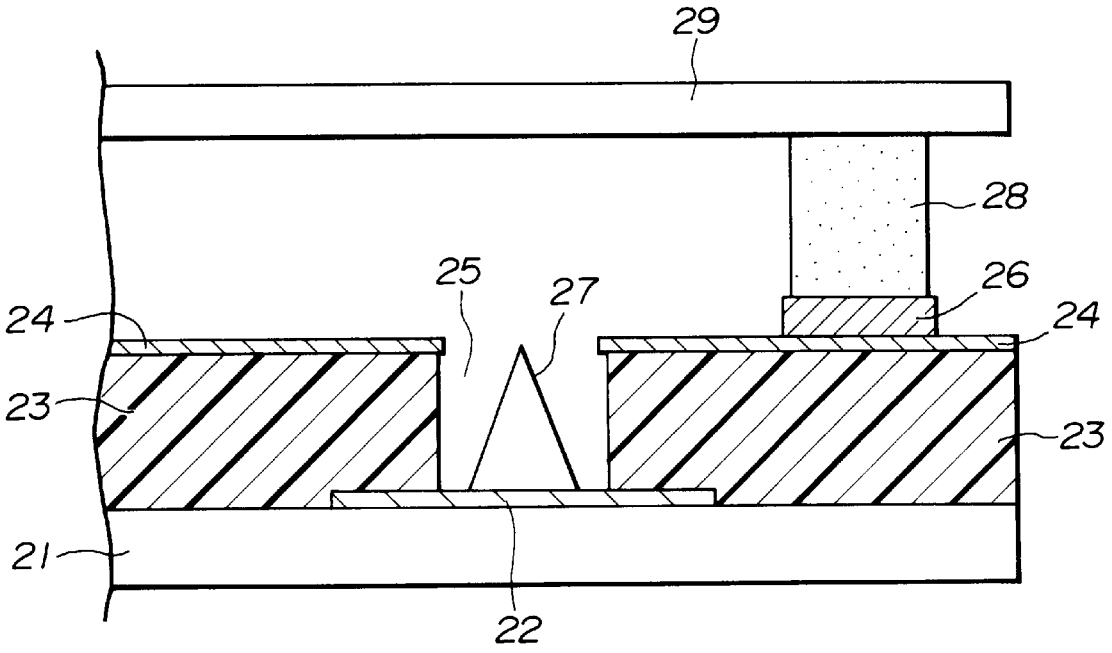
FIG. 11 is a fragmentary sectional view showing a conventional field emission device.

This permits a seal 11 for supporting an anode substrate 10 to be arranged on the protective film 9, as shown in FIG. 9.

Manufacturing of the field emission device in the manner shown in FIGS. 2 to 8(*b*) permits a part of the insulating layer 4 to be used for formation of the protective layer 9, to thereby eliminate a step of independently forming the protective layer 9, as described above. Also, it permits terminal lead-out of the cathode terminals 2*a* and gate terminals 3 to be concurrently carried out. Thus, it will be noted that the illustrated embodiment substantially simplifies manufacturing of the field emission device.

In addition, the present invention may be applied to connection for wirings such as chip on glass (COG) wirings or the like in the field emission device other than the gate terminals 3, as shown in FIG. 9. In this instance, connection elements 12 as well as the gate terminals 3 are arranged on the substrate 1 and then contact holes 5*b* and 5*c* as well as the contact holes 5 are subject to patterning, followed by execution of the steps shown in FIGS. 2 to 8(*b*), resulting in the insulating layers 4*a* and 4*b* and terminals 8*b* and 8*c* being formed.

Formation of such a field emission device realizes terminal lead-out of the gate terminals 8*a*, as well as wiring between a chip 13 and the FEC through the contact hole 5*b* and wiring between another component and the chip 13 through the contact hole 5*c*.

The present invention may be constructed in a manner different from the above. For example, the apertures in which the emitters are to be arranged and the contact holes having a size larger than the apertures may be concurrently subject to patterning, followed by formation of a conductive layer on only an inside of the contact holes by oblique deposition. Then, the peel layer is formed by oblique deposition and then the emitter layer is arranged on the peel layer by normal deposition, so that the emitters may be formed in the apertures.

As can be seen from the foregoing, the present invention is so constructed that the protective layer is formed of a part of the insulating layer arranged between the cathode electrodes and the gate electrodes. Such construction eliminates a step of independently forming the protective film. Also, in the present invention, the cathode terminals and gate terminals are formed on the same plane of the substrate, resulting in the terminal lead-out being accomplished by one-time etching. Further, the terminals are spaced from each other through the insulating layer, to thereby effectively prevent current leakage.

While a preferred embodiment of the present invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A field emission device comprising:

a field emission cathode substrate and an anode substrate sealedly joined to said field emission cathode substrate while being spaced therefrom;

cathode electrodes and gate terminals arranged on the same plane of said field emission cathode substrate;

gate lines arranged on said cathode electrodes through an insulating layer;

said insulating layer and gate lines being formed with apertures in a manner to commonly extend through said insulating layer and gate lines;

emitters of a conical shape arranged in said apertures to emit electrons therefrom; and contact holes through which said gate terminals and gate lines are connected to each other;

said insulating layer being so arranged that a part thereof formed on said gate terminals acts as a protective film for a seal for sealed joining of said anode substrate.

2. A field emission device as defined in claim 1, wherein said contact holes are formed into a diameter larger than that of said apertures.

3. A method for manufacturing a field emission device including a field emission cathode substrate and an anode substrate sealedly joined to the field emission cathode substrate while being spaced therefrom, comprising the steps of:

forming cathode electrodes and gate terminals on the same plane of said field emission cathode substrate, said cathode electrodes each having an end arranged so as to act as a cathode terminal;

forming an insulating layer on said cathode electrodes and gate terminals; and forming contact holes on said insulating layer;

whereby gate electrodes formed on said insulating layer are connected to said gate terminals through a conductive film formed in said contact holes during formation of said gate electrodes.

4. A method as defined in claim 3, wherein said contact holes are formed into a diameter larger than that of apertures in which field emission emitters are arranged.

5. A method as defined in claim 3 or 4, wherein said conductive film formed in said contact holes is formed by oblique deposition.

* * * * *

UNITED STATES PATENT AND TRADEMARK OFFICE

CERTIFICATE OF CORRECTION

PATENT NO. : 5,911,614

DATED : June 15, 1999

INVENTOR(S) : Norio NISHIMURA, et al.

It is certified that error appears in the above-identified patent and that said Letters Patent is hereby corrected as shown below:

On the title page, item [30] Foreign Application Priority Data has been omitted. It should be:

--[30] Foreign Application Priority Data
Apr. 9, 1996 [JP] Japan ..... 8-111152--

Signed and Sealed this

Eleventh Day of July, 2000

*Attest:*

*Attesting Officer*

Q. TODD DICKINSON

*Director of Patents and Trademarks*